US008621685B2

(12) United States Patent
Jin

(10) Patent No.: US 8,621,685 B2
(45) Date of Patent: Jan. 7, 2014

(54) EXTENDABLE FOLDING BED FRAME

(76) Inventor: Ki Ho Jin, Xiamen (CN)

( * ) Notice: Subject to any disclaimer, the term of this patent is extended or adjusted under 35 U.S.C. 154(b) by 0 days.

(21) Appl. No.: 13/469,522

(22) Filed: May 11, 2012

(65) Prior Publication Data

US 2012/0222216 A1 Sep. 6, 2012

Related U.S. Application Data

(63) Continuation-in-part of application No. 12/653,315, filed on Dec. 11, 2009.

(30) Foreign Application Priority Data

Nov. 11, 2011 (CN) ..... 2011 2 0445473 U
Dec. 28, 2011 (CN) ..... 2011 2 0558406 U

(51) Int. Cl.
*A47C 19/12* (2006.01)

(52) U.S. Cl.
USPC ..... 5/110; 5/112; 5/114

(58) Field of Classification Search
USPC ..... 5/110–112, 118, 425, 151, 154, 131
See application file for complete search history.

(56) References Cited

U.S. PATENT DOCUMENTS

| | | | |
|---|---|---|---|
| 14,668 | A | 4/1856 | Lefferts |
| 186,650 | A | 1/1877 | White |
| 203,605 | A | 5/1878 | Eastman |
| 337,416 | A | 3/1886 | McKeough |
| 545,608 | A | 9/1895 | Passmore |
| 549,675 | A | 11/1895 | Maxwell et al. |
| 621,252 | A | 3/1899 | Johnson et al. |
| 893,364 | A | 7/1908 | Piaser |
| 1,109,406 | A | 9/1914 | Dolge |
| 1,270,790 | A | 7/1918 | Coopersmith |
| 1,367,173 | A | 2/1921 | Berta |
| 1,464,420 | A | 8/1923 | Gish |
| 1,493,699 | A | 5/1924 | Pond |
| 1,581,858 | A | 4/1926 | Musgrave |
| 1,989,324 | A | 1/1935 | Levine |
| 1,990,600 | A | 2/1935 | Fridheim |
| 2,372,361 | A | 3/1945 | Cunningham |
| 2,542,744 | A | 2/1951 | Willens et al. |
| 2,678,085 | A | 5/1954 | De Minno |
| 2,976,545 | A | 3/1961 | Vanderminden |

(Continued)

FOREIGN PATENT DOCUMENTS

| | | | |
|---|---|---|---|
| CN | 1454556 | A | 11/2003 |
| JP | 10215981 | A | 8/1998 |

(Continued)

*Primary Examiner* — Fredrick Conley
(74) *Attorney, Agent, or Firm* — John H. Choi

(57) ABSTRACT

An extendable folding bed frame includes a pair of first sub-frames having a pair of spaced apart and extendable longitudinal bars, each longitudinal bar having a first end and a second end. The opposing longitudinal bars are fixedly connected together by a plurality of lateral support bars. The pair of first sub-frames are pivotally connected together at corresponding longitudinal bar first ends by first pivotal connecting members. The pair of first sub-frames are pivotable from an open configuration whereby each first sub-frame is aligned longitudinally to form a generally rectangular co-planar support surface and a folded configuration whereby each first sub-frame is substantially overlapped and adjacent to each other. The folding bed frame also includes a connecting bracket for attaching additional bed frames to provide a larger mattress support surface.

18 Claims, 11 Drawing Sheets

(56) References Cited

U.S. PATENT DOCUMENTS

| | | | | |
|---|---|---|---|---|
| 3,045,257 | A | 7/1962 | Knapp | |
| 3,134,987 | A | 6/1964 | Bertram | |
| 3,197,789 | A | 8/1965 | Ashkouti et al. | |
| 3,225,363 | A * | 12/1965 | Kirsch | 5/55.1 |
| 3,327,982 | A | 6/1967 | Kramer | |
| 3,949,434 | A * | 4/1976 | Anacker | 5/12.1 |
| 6,253,396 | B1 | 7/2001 | Weston | |
| 8,091,160 | B2 * | 1/2012 | Jin | 5/176.1 |
| 2006/0059620 | A1 | 3/2006 | Holub | |
| 2007/0277317 | A1 | 12/2007 | Ferko | |
| 2010/0005587 | A1 * | 1/2010 | Choi | 5/202 |

FOREIGN PATENT DOCUMENTS

| | | | |
|---|---|---|---|
| JP | 11346865 | A | 12/1999 |
| JP | 2003259940 | A | 9/2003 |
| WO | WO-2006076842 | A1 | 7/2006 |

* cited by examiner

EXTENDABLE FOLDING BED FRAME

CROSS REFERENCES TO RELATED APPLICATIONS

This application claims priority to China Patent Application No. 201120445473.4, filed Nov. 11, 2011, and China Patent Application No. 201120558406.3, filed Dec. 28, 2011, which are incorporated by reference in their entireties.

FIELD OF THE INVENTION

The present invention relates generally to foldable bed frames, and more particularly to an extendable folding bed frame capable of expanding and/or attaching with other foldable bed frames for providing larger surface areas to accommodate mattresses of different sizes.

DISCUSSION OF RELATED ART

Beds are traditionally a large piece of furniture used as a place to sleep and relax. Most modern beds consist of a mattress on a bed frame, with the mattress resting either on a solid base, often wooden slats, or a sprung base or box spring—a large-mattress sized box containing wood and springs that provide additional support and suspension for the mattress. For beds with box springs, standard collapsible rectangular metal bed frames are often used.

Some people, especially in Europe, Australia and Japan, prefer to dispense the box spring and bed frame, and replace it with a traditional platform bed style—a raised, level, usually rectangular horizontal solid frame, often with a section consisting of rows of flexible wooden slats or latticed structure meant to support just a mattress. This platform provides adequate, flexible support and ventilation for a mattress by itself, eliminating the need for a box-spring or a second mattress as a foundation.

With either type of traditional bed, however, there are unavoidable disadvantages. For example, traditional beds are not capable of easy assembly and disassembly because of the various components associated with the bed frame. Also, the bed frame, mattress and box spring of the traditional bed are heavy and thus not easily transportable. Furthermore, the traditional bed cannot be stored easily because the length of the bed frame as well as the mattress and box spring is often fixed and cannot be retracted or folded. Moreover, traditional beds are relatively expensive. Finally, for a retailer, traditional beds are almost impossible to sell off of store shelves because of size constraints.

For at least these reasons, alternative sleep solutions have been developed over the years. One of those solutions is a foldable bed frame capable of being folded at least in half. Foldable bed frames are manufactured and sold in different variations and designs. However, the common thread between foldable bed frames is that, for example, they are cost effective; light-weight; easily storable and transportable; and capable of being sold by retailers directly to the consumer from store shelves due to its light weight and relatively compact size.

Mattresses used with foldable bed frames vary in price and size as well. Even though traditional spring mattresses could be used with foldable bed frames, other mattresses that are light-weight and capable of easy storage and transport could also be used. For example, inflatable air mattresses, foldable spring mattresses and foldable foam mattresses are available at reasonable cost.

Despite these features, foldable bed frames in the prior art can only accommodate mattresses which are sized specifically for the particular foldable bed frame the mattress is used with. Thus, it is almost impossible to have a foldable bed frame or an assembly of foldable bed frames that is capable of accommodating various mattress sizes. Furthermore, for larger foldable bed frames, storage and transport is difficult even when folded because they are still quite bulky due to the fixed width of the bed frame.

Therefore, an extendable folding bed frame capable of accommodating different size mattresses while still being light-weight and capable of being compactly stored and transported is desired.

SUMMARY OF THE INVENTION

The present invention is intended to overcome at least the above-described disadvantages and to provide further improvements to foldable bed frames in the prior art. The objects and advantages of the present invention, more specifically, are to provide an extendable folding bed frame for expanding and/or attaching with other foldable bed frames to provide larger surface areas to accommodate mattresses of different sizes while still being light-weight and capable of being compactly stored and transported.

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

For achieving the above-mentioned objects, the present invention generally provides an extendable folding bed frame comprising a pair of first sub-frames. Each first sub-frame comprises a pair of spaced apart longitudinal bars, each longitudinal bar having a first end and a second end. The opposing longitudinal bars are fixedly connected together by a plurality of lateral support bars. The pair of first sub-frames are pivotally connected together at corresponding longitudinal bar first ends by first pivotal connecting members. A first leg assembly is fixedly attached to the first sub-frames proximate the first pivotal connecting member. The foldable bed frame also includes a pair of second leg assemblies. Each second leg assembly is pivotally attached to each first sub-frame. The pair of first sub-frames are pivotable from an open configuration whereby each first sub-frame is aligned longitudinally to form a generally rectangular co-planar support surface and a folded configuration whereby each first sub-frame is substantially overlapped and adjacent to each other.

In one embodiment, the foldable bed frame comprises a second sub-frame comprising a pair of spaced apart lateral extension bars, each lateral extension bar having a first end and a second end. The first ends of each lateral extension bar are pivotally connected to a longitudinal bar of one of the first sub-frames by a second pivotal connecting member. The second ends of each lateral extension bar have a first connecting bracket fixedly attached thereto. In a retracted configuration the second sub-frame is disposed within and substantially co-planar with the one of the first sub-frames. In an extended configuration the second sub-frame is pivotally extended adjacent to and substantially co-planar with the first sub-frame and engaged with an adjacent structure to form an expanded support surface.

In another embodiment, the longitudinal bars of at least one first sub-frame of the foldable bed frame are extendable to form an expanded support surface. Illustratively, the longitudinal bars of at least one first sub-frame are extendable with respect to the first pivotal connecting members along a longitudinal axis of the at least one first sub-frame.

Another aspect of the present invention includes a second connecting bracket including a base having a plurality of opposing outer walls extending upwardly from opposing edges of the base and at least one inner wall extending upwardly from an inner portion of the base substantially parallel to the outer walls such that a plurality of engaging spaces are formed between the walls. Each engaging space corresponds to a predetermined mattress size. In the open configuration of the bed frame one of the plurality of engaging spaces is engaged with one of the first sub-frames and another one of the plurality of engaging spaces is engaged with an adjacent structure to form a larger mattress engaging surface.

BRIEF DESCRIPTION OF THE DRAWINGS

The above and other objects, features and advantages of the present invention will be more apparent from the following detailed description taken in conjunction with the accompanying drawings, in which.

Figure 1:
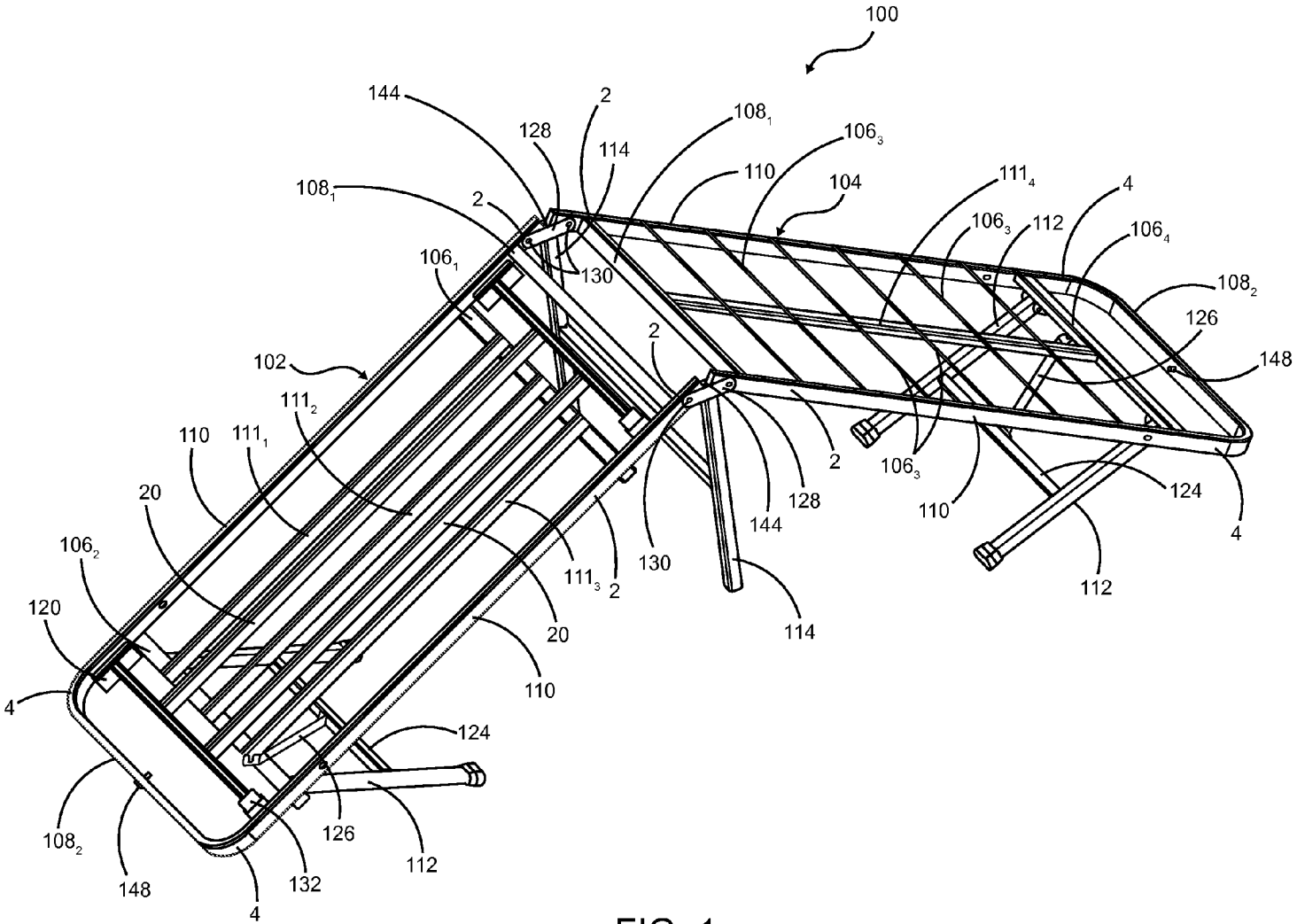
FIG. 1 is a perspective view of a first embodiment of a foldable bed frame of the present invention in a partially folded configuration.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION OF THE PREFERRED EMBODIMENTS

Exemplary embodiments are described herein to provide a detailed description of the invention. Variations of these embodiments will be apparent to those of skill in the art.

First Embodiment

Referring to FIGS. 1-5, a foldable bed frame of a first embodiment of the present invention 100 (sometimes referred to as $\mathbf{100}_1$ and $\mathbf{100}_2$) is illustrated. The foldable bed frame 100 includes a pair of first sub-frames 102, 104. Each first sub-frame 102, 104 includes a pair of spaced apart longitudinal bars 110 in parallel arrangement. Each longitudinal bar 110 has a first end 2 and a second end 4, and the opposing longitudinal bars 110 are fixedly connected together by lateral support bars $\mathbf{108}_1$ and $\mathbf{108}_2$ at opposing longitudinal bar first ends 2 and at opposing longitudinal bar second ends 4, respectively. In the preferred embodiment, the inner lateral support bar $\mathbf{108}_1$ is welded onto opposition longitudinal bars 110 but the outer lateral support bar $\mathbf{108}_2$ is integral with the longitudinal bars 110 in that the outer lateral support bar $\mathbf{108}_2$ is formed by bending an elongated hollow steel bar into two right angles. One of ordinary skill in the art will recognize that separate components could be welded or fastened together to form the second end 4 of the first sub-frame 102, 104 without departing from the spirit and scope of the invention.

Figure 4:
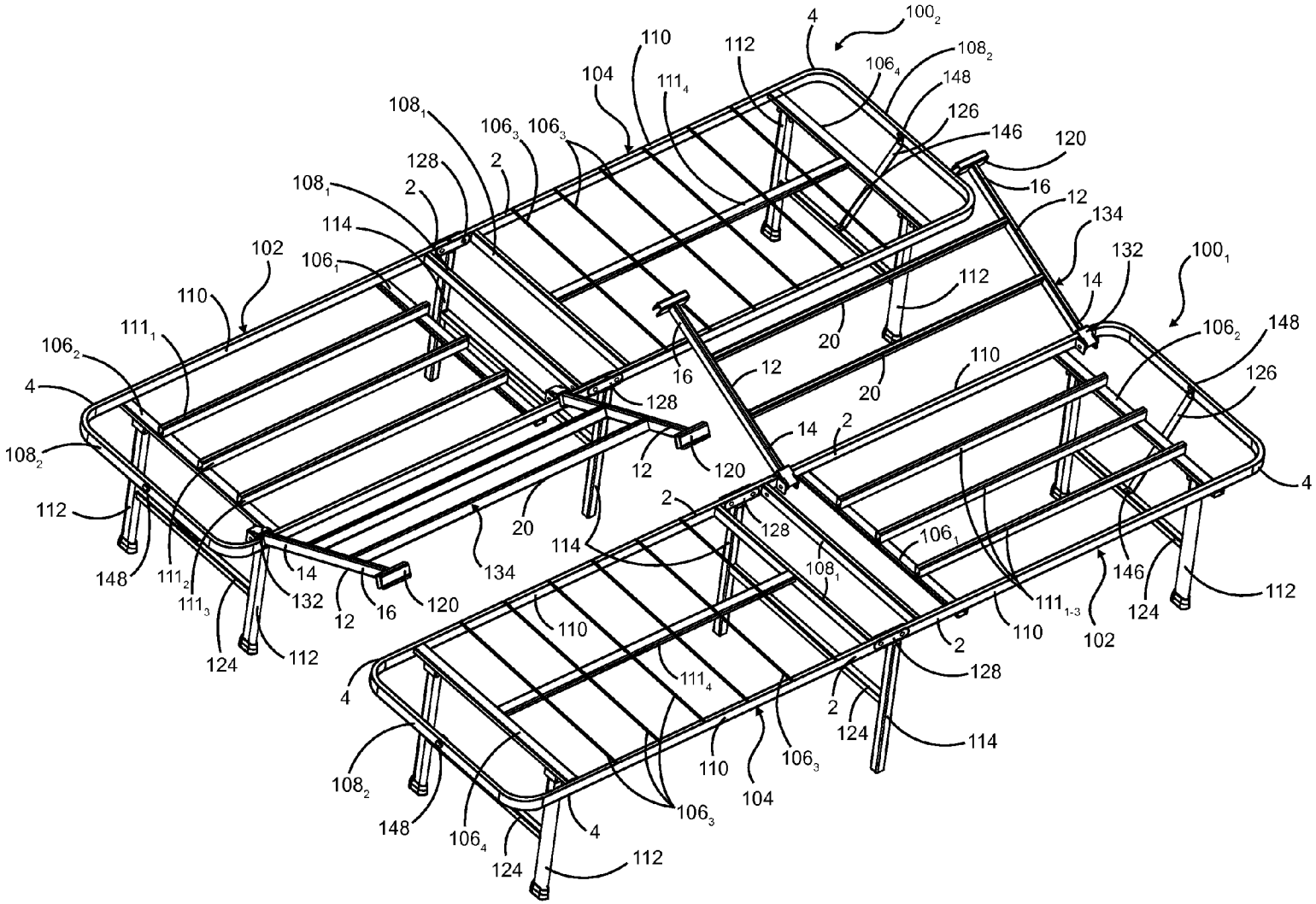
FIG. 4 is a perspective view of two adjacent foldable bed frames of FIG. 1 in an open configuration with corresponding second sub-frames in a partially extended configuration.

Referring to FIG. 4, in the preferred embodiment, one of the first sub-frames 102 includes two spaced apart auxiliary lateral support bars $\mathbf{106}_1$ and $\mathbf{106}_2$ fixedly attached, preferably by welding, to a bottom portion of opposing longitudinal support bars 110. Three spaced apart auxiliary longitudinal support bars $\mathbf{111}_1$, $\mathbf{111}_2$ and $\mathbf{111}_3$ are fixedly attached, preferably by welding, onto top surfaces of the auxiliary lateral support bars $\mathbf{106}_1$ and $\mathbf{106}_2$ such that the top surfaces of auxiliary longitudinal support bars $\mathbf{111}_1$, $\mathbf{111}_2$ and $\mathbf{111}_3$ are co-planar with the longitudinal support bars 110 and the lateral support bars $\mathbf{108}_1$ and $\mathbf{108}_2$.

Referring again to FIG. 4, in the preferred embodiment, the other first sub-frame 104 includes an auxiliary lateral support bar $\mathbf{106}_4$ fixedly attached, preferably by welding, to inner side portions of opposing longitudinal support bars 110. An auxiliary longitudinal support bar $\mathbf{111}_4$ is fixedly attached to an inner side portion of the inner later support bar $\mathbf{108}_1$ on one end and an inner side portion of the auxiliary lateral support bar $\mathbf{106}_4$ on another end, preferably by welding, such that the top surfaces of the top surfaces of the auxiliary longitudinal support bar $\mathbf{111}_4$ and the auxiliary lateral support bar $\mathbf{106}_4$ are co-planar with the longitudinal support bars 110 and lateral support bars $\mathbf{108}_1$ and $\mathbf{108}_2$. The first sub-frame 104 further includes a plurality of spaced apart auxiliary lateral support bars $\mathbf{106}_3$ constructed of thin yet durable tubular metal that are welded onto opposing longitudinal support bars 110 and the auxiliary longitudinal support bar $\mathbf{111}_4$. One of ordinary skill in the art will recognize that other materials and shapes could be used for the lateral support bars $\mathbf{106}_3$, and the number of longitudinal supports as well as lateral supports for each first sub-frame 102, 104 could vary so long as a secure engaging surface is maintained.

Referring to FIGS. 1-5, the pair of first sub-frames 102, 104 are pivotally connected together at corresponding first ends of the longitudinal bars 2 by first pivotal connecting members 128. In the preferred embodiment, the first pivotal connecting member 128 is substantially U-shaped with an open interface 144 for which each corresponding longitudinal support member first end 2 is disposed within and pivotally attached to the first pivotal connecting member 128 with a fastener 130 such as a screw, rivet or the like.

Figure 2:
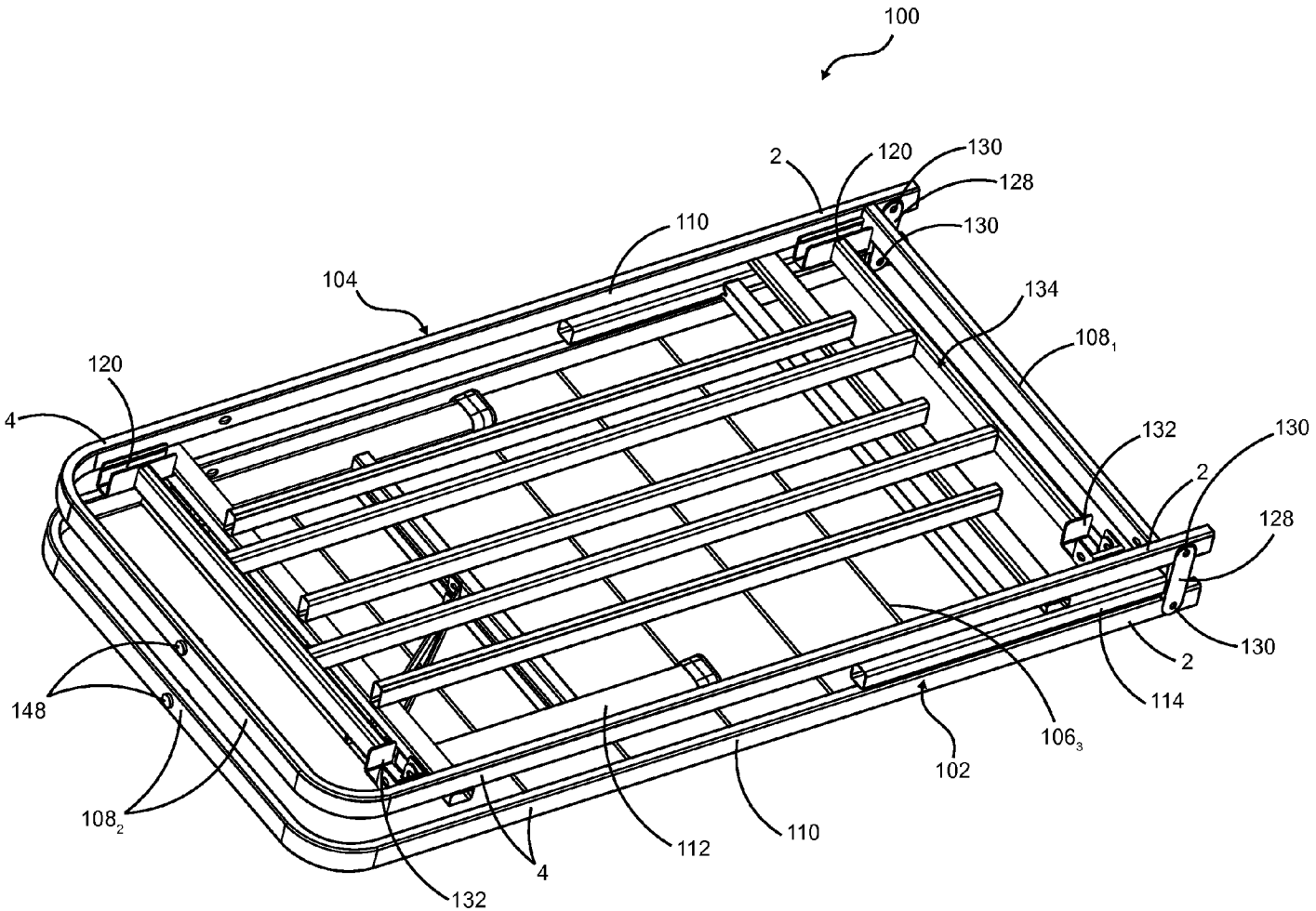
FIG. 2 is a perspective view of the foldable bed frame of FIG. 1 in a folded configuration.

Referring to FIGS. 1 and 2, a first leg assembly 114 is fixedly attached to a lower portion of the first pivotal connecting member 128, preferably by welding. The first pivotal connecting member 128 could also be constructed of two opposing plates and the first leg assembly 114 fixedly connected to bottom edges of each opposing plate. In the preferred embodiment, the first leg assembly 114 includes a lateral leg support member 124 fixedly attached to the upright members of the first leg assembly 114, preferably by welding, to provide additional stability to the mid portion of the bed frame 100.

Referring again to FIGS. 1 and 2, the bed frame 100 includes a pair of second leg assemblies 112 to provide peripheral support to the bed frame 100. In the preferred embodiment, each second leg assembly 112 also includes a lateral leg support member 124 fixedly attached to the upright members of the second leg assembly 112, preferably by welding, to provide additional stability to the ends of the bed frame 100. In the preferred embodiment, the second leg assemblies 112 are pivotally connected to bottom portions of the outer auxiliary lateral support bars $\mathbf{106}_2$ and $\mathbf{106}_4$ but the second leg assemblies 112 could also be connected to other portions of the first sub-frame 102, 104 such as inner portions of the longitudinal support bars 110 or to other lateral support bars on the first sub-frame 102, 104. Each second leg assembly 112 is further secured to each first sub-frame with a support brace 126 which is pivotally connected to the lateral leg support member 124 on one end with a fastener 146 such as a screw or rivet, and detachably connected to the outermost lateral support bar $\mathbf{108}_2$ with a fastener 148 such as a screw on another end. When the bed frame 100 is in an open configuration, as shown for example in FIG. 3, the support brace 126 is fixedly connected to the outer lateral support bar $\mathbf{108}_2$ via the fastener 148 and when the bed frame 100 is folded, as shown for example in FIGS. 1 and 2, the fastener 148 is disengaged and the support brace 126 pivoted to a position parallel to the second leg assembly 112. In the alternative, each second leg assembly 112 could be attached to each first sub-frame 102, 104 by other means such as a sliding brace that is pivotably and lockably engaged with the longitudinal bars 110.

Figure 3:
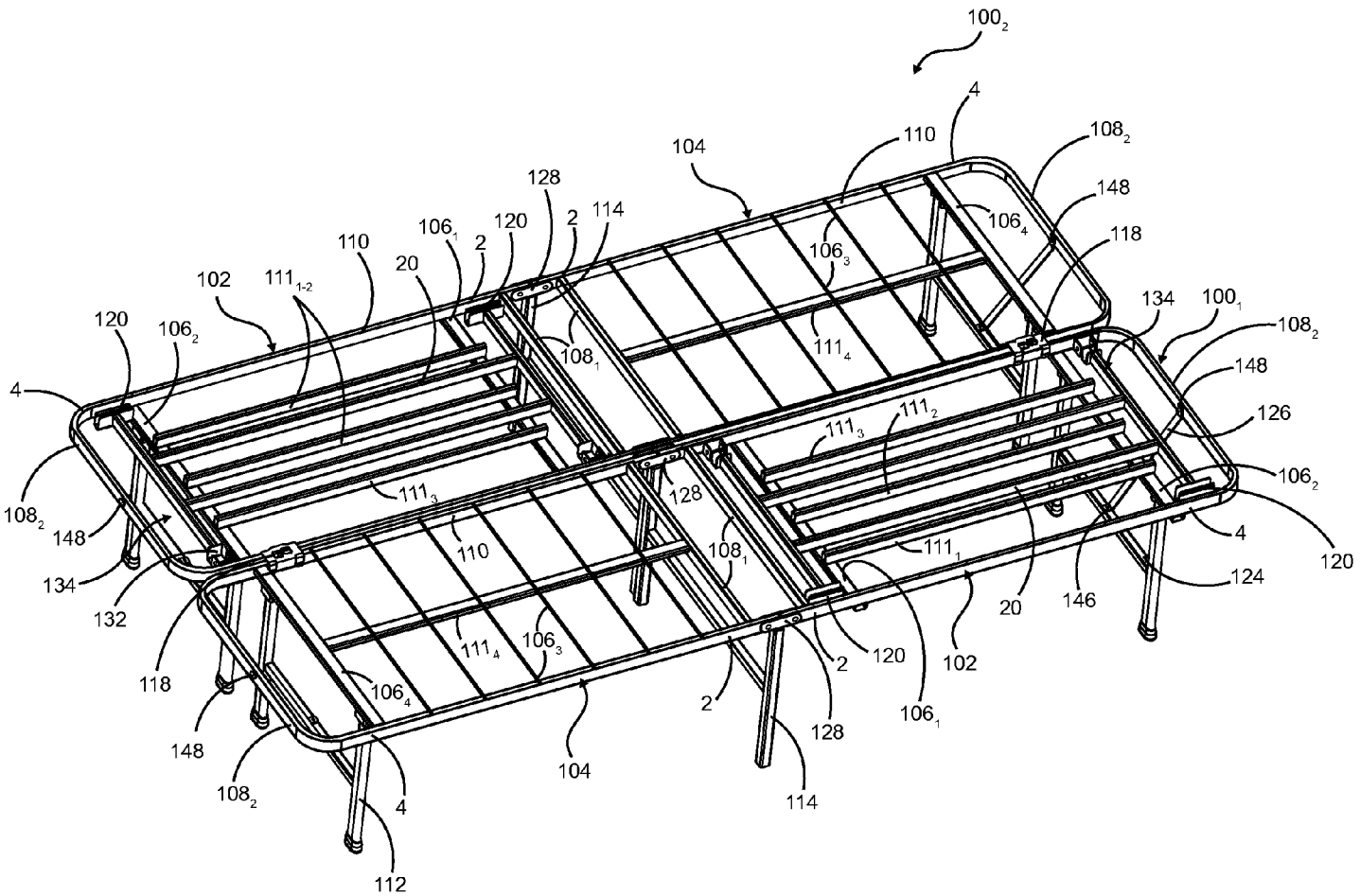
FIG. 3 is a perspective view of two adjacent foldable bed frames of FIG. 1 in an open configuration coupled together with a connecting bracket of a first embodiment shown in FIG. 10.

Referring to FIGS. 2 and 3, the pair of first sub-frames 102, 104 are pivotable from an open configuration as shown in FIG. 3 whereby each first sub-frame 102, 104 is aligned longitudinally to form a generally rectangular co-planar support surface. In the folded configuration as shown in FIG. 2, each first sub-frame 102, 104 is substantially overlapped and adjacent to each other in a compact state for easy storage and transport.

Figure 5:
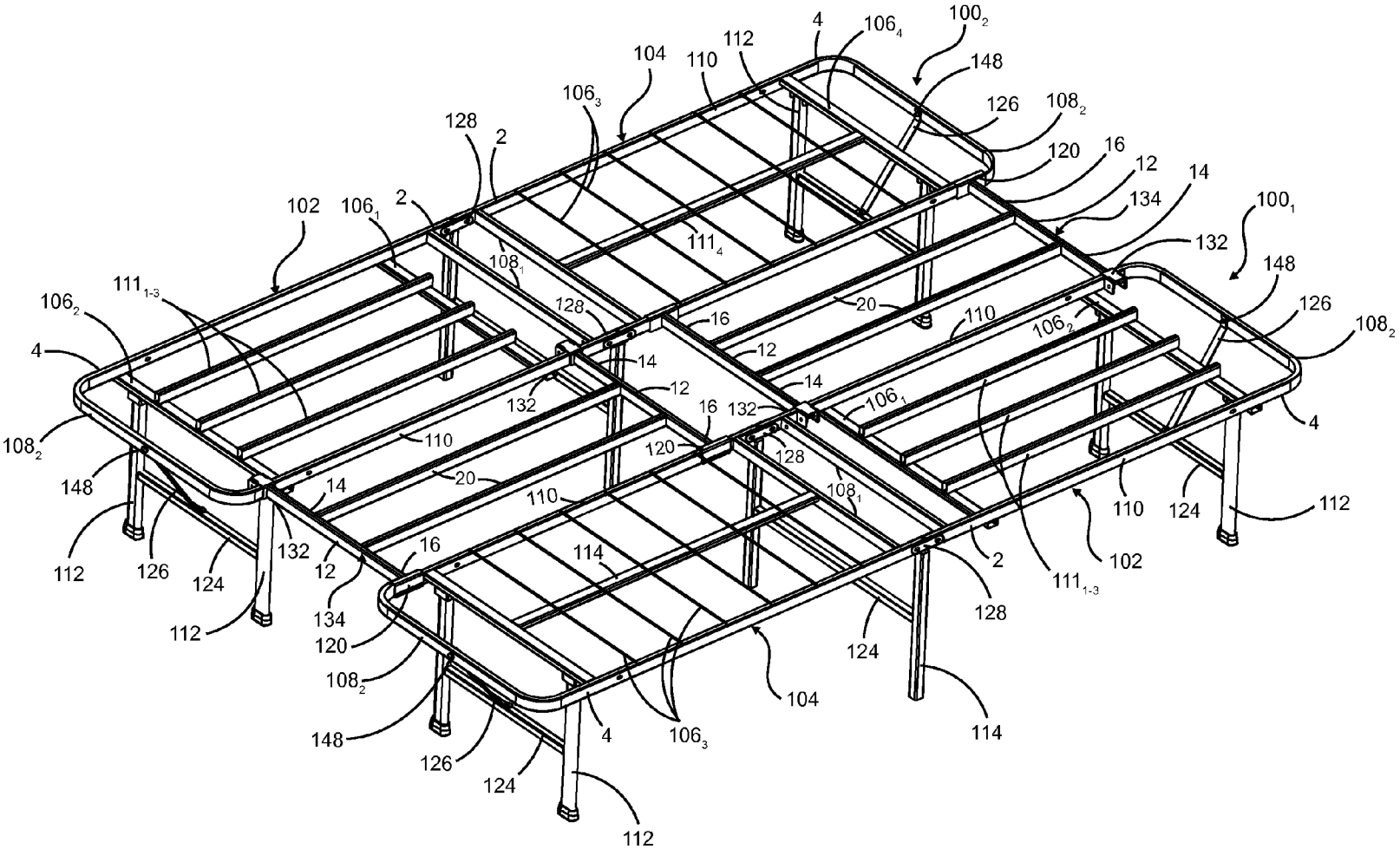
FIG. 5 is a perspective view of two adjacent foldable bed frames of FIG. 1 in an open configuration engaged with opposing second sub-frames in an extended configuration.

Referring to FIGS. 4-5, the foldable bed frame 100, and more specifically, one of the first sub-frames 102, includes a second sub-frame 134. The second sub-frame 134 includes a pair of spaced apart lateral extension bars 12 in parallel arrangement. Each lateral extension bar 12 includes a first end 14 and a second end 16. The opposing lateral extension bars 12 are fixedly connected together by two longitudinal extension bars 20, preferably by welding, but other attachment methods could be used without departing from the spirit and scope of the present invention. Also, even though two longitudinal extension bars are used in the preferred embodiment, the number of longitudinal extension bars could vary depending on preference. The lateral extension bars 12 and the longitudinal extension bars 20 are configured such that when the bed frame 100 is opened the top surfaces are substantially co-planar for an even mattress engaging surface. The top surfaces of the lateral extension bars 12 and the longitudinal extension bars 20 are also substantially co-planar with the top surfaces of the longitudinal support bars 110 and auxiliary longitudinal support bars $\mathbf{111}_{1\text{-}3}$ when the second sub-frame 134 is fully extended.

Referring to FIGS. 2-5, the first end of each lateral extension bar 14 is pivotally connected to a longitudinal bar of one of the first sub-frames 110 by a second pivotal connecting member 132. Referring to FIG. 2, the second pivotal connecting member 132 includes a substantially U-shaped member for securing to longitudinal support bars 110 of corresponding first sub-frames 102, 104 when the second sub-frame 134 is in the extended configuration. The U-shaped member is sized such that the inner width is substantially similar to the width of the longitudinal support bar 110 such that when engaged in the open configuration of the bed frame 100 the U-shaped member fits onto the longitudinal support bar 110. One with ordinary skill in the art will recognize that the shape and size of the U-shaped member of the second pivotal connecting member 132 could vary to accommodate other types of frames.

Referring again to FIGS. 2-5, the second end of each lateral extension bar 16 includes a first connecting bracket 120 fixedly attached thereto, preferably by welding. In the preferred embodiment, the first connecting brackets 120 of the second sub-frame 134 are substantially U-shaped and sized such that the inner width of the first connecting bracket 120 is substantially similar to the width of the longitudinal support bars 110. One with ordinary skill in the art will recognize that the shape and size of the first connecting bracket 120 could vary to accommodate other structures that the second sub-frame 134 would connect to.

Referring to FIGS. 1 and 3, and in particular to one of the first sub-frames 102, in a retracted configuration the longitudinal extension bars 20 are disposed on a top surface of the auxiliary lateral support bars $\mathbf{106}_{1\text{-}2}$ and between the auxiliary longitudinal support bars $\mathbf{111}_{1\text{-}3}$ such that the second sub-frame 134 is disposed within the first sub-frame 102 and the top surfaces of the first and second sub-frames 102, 134 are substantially co-planar. The co-planar relationship between the first and second sub-frames 102, 104, 134 provides a substantially flat mattress engaging surface throughout the length of the bed frame 100 when used as a single bed frame for a smaller size mattress or when used side-by-side, as described in more detail below, for an intermediate size mattress. Moreover, the co-planar relationship provides a compact arrangement when the bed frame 100 is folded as shown in FIG. 2. In an embodiment, each foldable bed frame 100 while in an open configuration with the second sub-frame 134 retracted, as illustratively shown in FIG. 3, is preferably 19.5 inches wide and 75 inches long.

Referring to FIG. 5, in an extended configuration the second sub-frame 134 is pivotally extended and the first connecting brackets 120 of the second sub-frame 134 of one foldable bed frame $\mathbf{100}_1$ or $\mathbf{100}_2$ is engaged with the longitudinal support bar 110 of an adjacent foldable bed frame $\mathbf{100}_2$ or $\mathbf{100}_1$ to form an expanded mattress support surface. The top surfaces of the first and second sub-frames 102, 104, 134 are adjacent to and substantially co-planar with each other to form a substantially flat mattress engaging surface for larger mattresses. In the preferred embodiment, the second sub-frame provides an additional 15 inches laterally to form a full size bed frame (54"×75").

Figure 10:
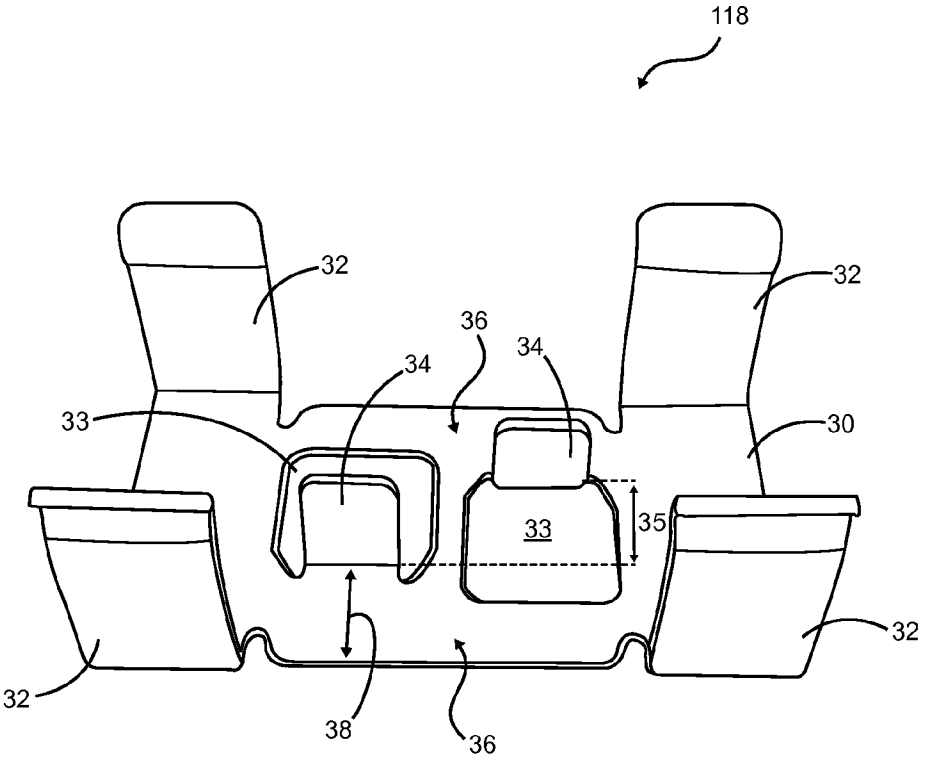
FIG. 10 is a bottom perspective view of a connecting bracket of a first embodiment of the present invention.

Referring to FIGS. 3 and 10, in another embodiment of the present invention, two or more foldable bed frames 100 could be connected directly to each other in a side-by-side arrangement with a second connecting bracket 118 without extending the second sub-frames 134 to form a support surface for a mattress of an intermediate size. Referring to FIG. 10, the second connecting bracket 118 includes a base 30 having a plurality of opposing outer walls 32 extending upwardly from opposing edges of the base 30. The second connecting bracket 118 is constructed of a hard metal such as steel to provide strength and durability but other strong and durable materials such as a hard plastic could be used. At least one inner wall 34 extends upwardly from an inner portion of the base 30 substantially parallel to the outer walls 32 such that a plurality of engaging spaces 36 are formed between the walls 32, 34. A plurality of openings 33 are formed by virtue of the manufacturing process as the material from the base 30 is punched and bent at right angles to form the inner walls 34. The width 38 of each engaging space 36 is substantially similar to the width of the longitudinal support bars 110 such that when engaged, the second connecting bracket 118 is sufficiently snug with the longitudinal support bars 110 to prevent movement of the adjacent bed frames $\mathbf{100}_{1\text{-}2}$. A small gap 35 is formed between the inner walls 34 to provide tolerance for any lateral movement of the inner walls 34 if the longitudinal support bars 110 are wider than the engaging spaces 36. In the preferred embodiment, attaching the two bed frames sides-by-side with the second connecting bracket 118 forms a bed frame with dimensions substantially similar to a twin size mattress (39"×75").

The preferred embodiments are geared toward the U.S. market and thus the dimensions of the foldable bed frame 100, including the second sub-frame 134 are as such. One of ordinary skill in the art will recognize that the dimensions of the foldable bed frame 100 as well as the second connecting bracket 118 could be customized or varied depending on the target market.

Second Embodiment

Referring to FIGS. 6-9, a foldable bed frame of a second embodiment 200 (sometimes referred to as $\mathbf{200}_1$, $\mathbf{200}_2$, $\mathbf{200}_3$ and $\mathbf{200}_4$) of the present invention is shown. The foldable bed frame 200 includes a pair of first sub-frames 202, 204. Each first sub-frame 202, 204 includes a pair of spaced apart longitudinal bars 210 in parallel arrangement. Each longitudinal bar 210 has a first end 52 and a second end 54, and the opposing longitudinal support bars 210 are fixedly connected together by lateral support bars $\mathbf{208}_1$ and $\mathbf{208}_2$ at opposing longitudinal bar first ends 52 and at opposing longitudinal bar second ends 54, respectively. In the preferred embodiment, the lateral support bar $\mathbf{208}_2$ at the second end 54 is integral with the longitudinal bars 210 and are formed at substantially right angles by bending a continuous hollow bar of rectangular cross-section into a substantially U-shaped configuration. However, each longitudinal support bar 210 and the lateral support bar $\mathbf{208}_2$ at the second end 54 could be separately welded together. The lateral support bar $\mathbf{208}_1$ at the first end 52 is fixed to the opposing longitudinal bars 210 by welding. The top surfaces of each longitudinal bar 210 and each lateral support bar $\mathbf{208}_{1\text{-}2}$ are substantially co-planar.

Referring again to FIGS. 6-9, each first sub-frame 202, 204 also includes an auxiliary longitudinal support bar 211 welded onto the lateral support bars $\mathbf{208}_{1\text{-}2}$ parallel to the longitudinal support bars 210 such that the top surface of the auxiliary longitudinal support bar 211 is substantially co-planar with the longitudinal support bars 210 and lateral support bars $\mathbf{208}_{1\text{-}2}$. A plurality of auxiliary lateral support bars 206 extend across each first sub-frame 202, 204 in equidistant arrangement. The auxiliary lateral support bars 206 are constructed of a thin but durable tubular metal and are welded onto the top surfaces of the longitudinal support bars 210, 211 to form a co-planar engaging surface for a mattress and for providing additional support to the overall structure of the bed frame 200. Other materials and different shapes could be used for the construction of the auxiliary lateral support bars 206.

Referring to FIGS. 6-9, in one of the first sub-frames 202, an additional lateral support bar 209 is welded onto opposing longitudinal support bars 210 intermediate the lateral support bars $\mathbf{208}_{1\text{-}2}$. Moreover, the longitudinal support bars 210, 211 of the first sub-frame 202 are telescopically extendable at longitudinal support bar first ends 52. That is, the longitudinal support bars 210, 211 of at least one first sub-frame 202, 204 are extendable with respect to the first pivotal connecting members 228 along a longitudinal axis of the at least one first sub-frame. Specifically, the first ends 52 of the longitudinal support bars include inner bars 213 slidably positioned (inserted) within the longitudinal support bars 210, 211. Each inner bar 213 which is slidable within the intermediate auxiliary longitudinal support bar 211 includes a spring biased depressible locking pin (not shown) for engaging first and second apertures 215, 217 of the corresponding auxiliary longitudinal support bar 211. The spring biased locking pin engages the second aperture 217 in a retracted configuration and the spring biased locking pin engages the first aperture 215 in an extended configuration, as shown for example in FIGS. 7 and 8, respectively. In the preferred embodiment, the distance between the first and second apertures 215, 217 is 5 inches, but this distance can vary depending on desired extendability. The same telescoping construction can be utilized on the other first sub-frame 204 to provide additional extendability thereto. Furthermore, the telescoping feature could be utilized on the foldable bed frame of the first embodiment 100.

Referring again to FIGS. 6-9, the pair of first sub-frames 202, 204 are pivotally connected together at corresponding first ends 52 of the longitudinal support bars 210 by first pivotal connecting members 228. In the preferred embodiment, the first pivotal connecting member 228 is substantially U-shaped with an interface (not shown) and each corresponding longitudinal support bar 210 first end 52 is disposed within the interface and pivotally attached to the first pivotal connecting member 228 with a fastener such as a screw, rivet or the like. With regard to the inner bars 213 corresponding to the longitudinal support bars 210 of one of the first sub-frames 202, a cap 219 is attached to the inner ends to conform with the dimensions of the interface of the first pivotal connecting member 228, and each fastener is extended through the cap 219 as well as the inner bar 213.

Referring to FIGS. 6-9, a first leg assembly 214 is fixedly attached to a lower portion of the first pivotal connecting member 228, preferably by welding. The first pivotal connecting member 228 could also be constructed of two opposing plates and the first leg assembly 214 fixedly connected to bottom edges of each opposing plate. In the preferred embodiment, the first leg assembly 214 includes a lateral leg support member 224 fixedly attached to the upright members of the first leg assembly 214, preferably by welding, to provide additional stability to the mid portion of the bed frame 200.

Referring again to FIGS. 6-9, the bed frame 200 also includes a pair of second leg assemblies 212 to provide peripheral support to the bed frame 200. In the preferred embodiment, each second leg assembly 212 also includes a lateral leg support member 224 fixedly attached to the upright members of the second leg assembly 212, preferably by welding, to provide additional stability to the ends of the bed frame 200. In the preferred embodiment, the second leg assemblies 212 are pivotally connected to inner side portions of opposing longitudinal support bars 210 but the second leg assemblies 212 could also be connected to other portions of the first sub-frame 202, 204 without departing from the sprit and scope of the invention. Each second leg assembly 212 is further secured to each first sub-frame with a support brace 226 which is pivotally connected to the lateral leg support member 224 on one end with a fastener 246 such as a screw or rivet and detachably connected to the outermost lateral support bar 208 with a fastener 248 such as a screw on another end. When the bed frame 200 is in an open configuration, as shown in FIGS. 6-9, the support brace 226 is fixedly connected to the lateral support bar 208 via the fastener 248 and when the bed frame 200 is folded, as illustratively shown for example in FIGS. 1 and 2, the fastener 248 is disengaged and the support brace 226 pivoted to a position parallel to the second leg assembly 212. In the alternative, each second leg assembly 212 could be attached to each first sub-frame 202, 204 by other means such as a sliding brace that is pivotably and lockably engaged with the longitudinal bars 210.

The foldable bed frame of the second embodiment 200 is opened and folded substantially similar to the foldable bed frame of the first embodiment 100. Referring to FIGS. 6-9, the pair of first sub-frames 202, 204 are pivotable from an open configuration whereby each first sub-frame 202, 204 is aligned longitudinally to form a generally rectangular substantially co-planar support surface. In the folded configuration as illustratively shown in FIG. 2, each first sub-frame 202, 204 is substantially overlapped and adjacent to each other in a compact state for easy storage and transport.

Figure 6:
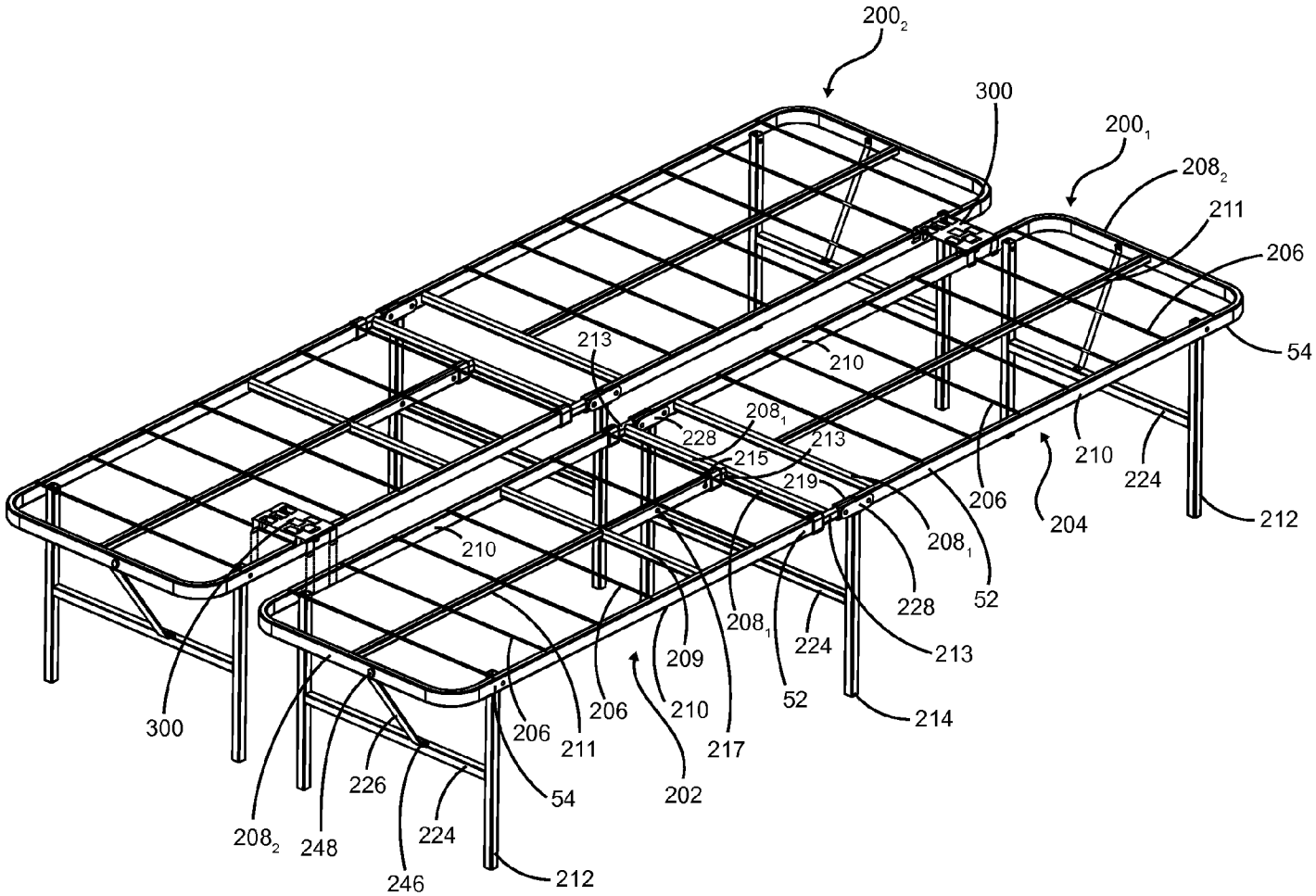
FIG. 6 is a perspective view of two adjacent foldable bed frames of a second embodiment of the present invention in an open configuration connected together with connecting brackets of a second embodiment of the present invention shown in FIG. 11 to form a twin size bed frame.

Referring to FIG. 6, in the preferred embodiment, in the open configuration with the longitudinal bars 210, 211 retracted, the bed frame 200 is 75 inches in length, 18 inches in width and 14 inches in height. In this configuration, the foldable bed frame 200 could be used alone with a mattress of same or similar dimensions as the bed frame top surface, i.e., 18"×75". However, a plurality of bed frames 200 could be attached side-by-side by a third connecting bracket 300 to provide larger support surfaces for larger mattresses including conventional U.S. sizes, i.e., twin, full, queen and king, as described in more detail below.

Figure 11:
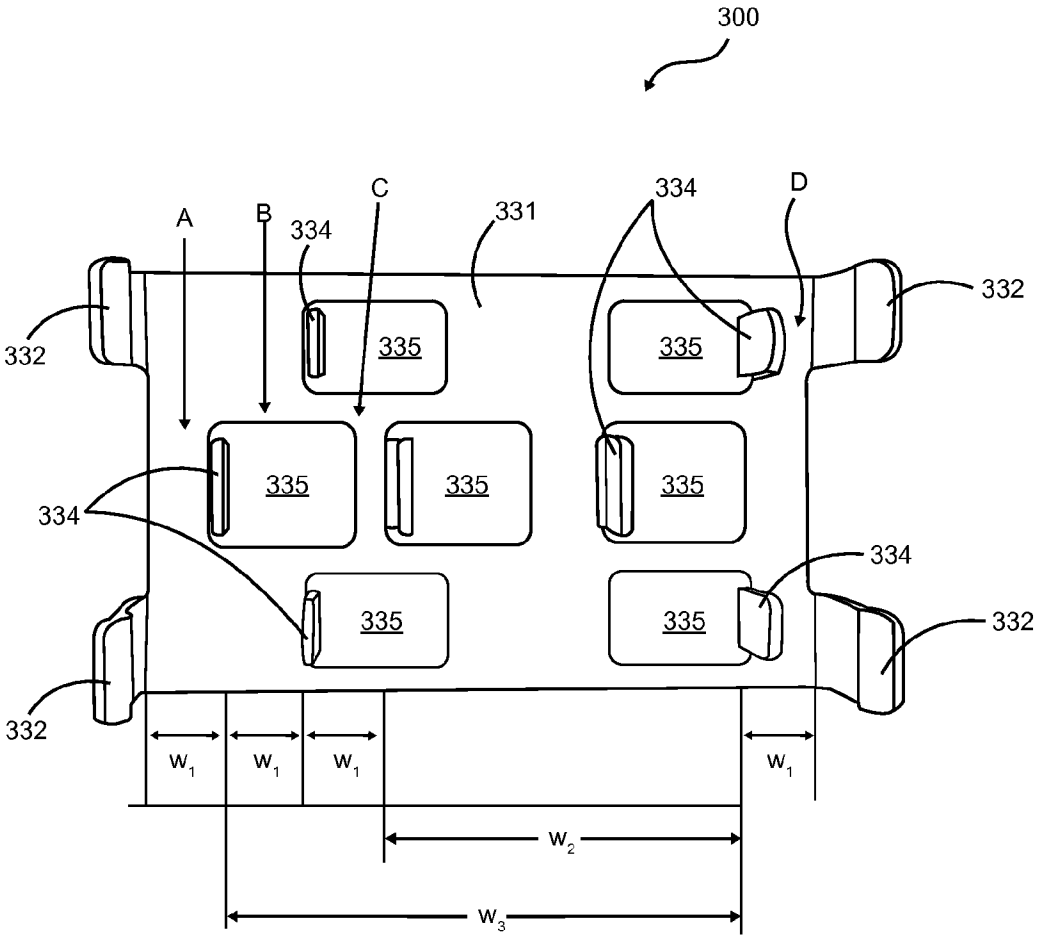
FIG. 11 is a bottom view of a connecting bracket of a second embodiment of the present invention.

Referring to FIG. 11, the third connecting bracket 300 (sometimes referred to as $\mathbf{300}_1$, $\mathbf{300}_2$ and $\mathbf{300}_3$) includes a base 331 having a plurality of opposing outer walls 332 extending upwardly from opposing edges of the base 331. A plurality of inner walls 334 extend upwardly from an inner portion of the base 331 substantially parallel to the outer walls 332 such that a plurality of engaging spaces A, B, C and D are formed between the walls 332, 334. A plurality of openings 335 are formed by virtue of the manufacturing process as the material from the base 331 is punched and bent at right angles to form the inner walls 334. The width $W_1$ of the engaging spaces A, B, C and D are substantially similar to the lateral thickness of the longitudinal support bars 210 such that when engaged, the third connecting bracket 300 is sufficiently snug with the longitudinal support bars 210 to prevent movement of the adjacent bed frames 200. In the preferred embodiment, the engaging spaces A, B, C and D are spaced apart such that a distance $W_2$ between inner ends of engaging spaces C and D is 2" and a distance $W_3$ between inner ends of engaging spaces A and D is 3". The third connecting bracket 300 is constructed of a hard metal such as steel to provide strength and durability but other strong and durable materials such as a hard plastic could be used.

Referring to FIG. 6, to construct a bed frame for a twin size mattress (39"×75"), two bed frames $\mathbf{200}_1$ and $\mathbf{200}_2$ with the longitudinal bars 210, 211 in a retracted configuration (75") are positioned adjacent to each other and a pair of third connecting brackets 300 are engaged in engaging spaces A and D with adjacent longitudinal support bars 210 to form a 3" gap between adjacent bed frames $\mathbf{200}_1$ and $\mathbf{200}_2$.

Figure 7:
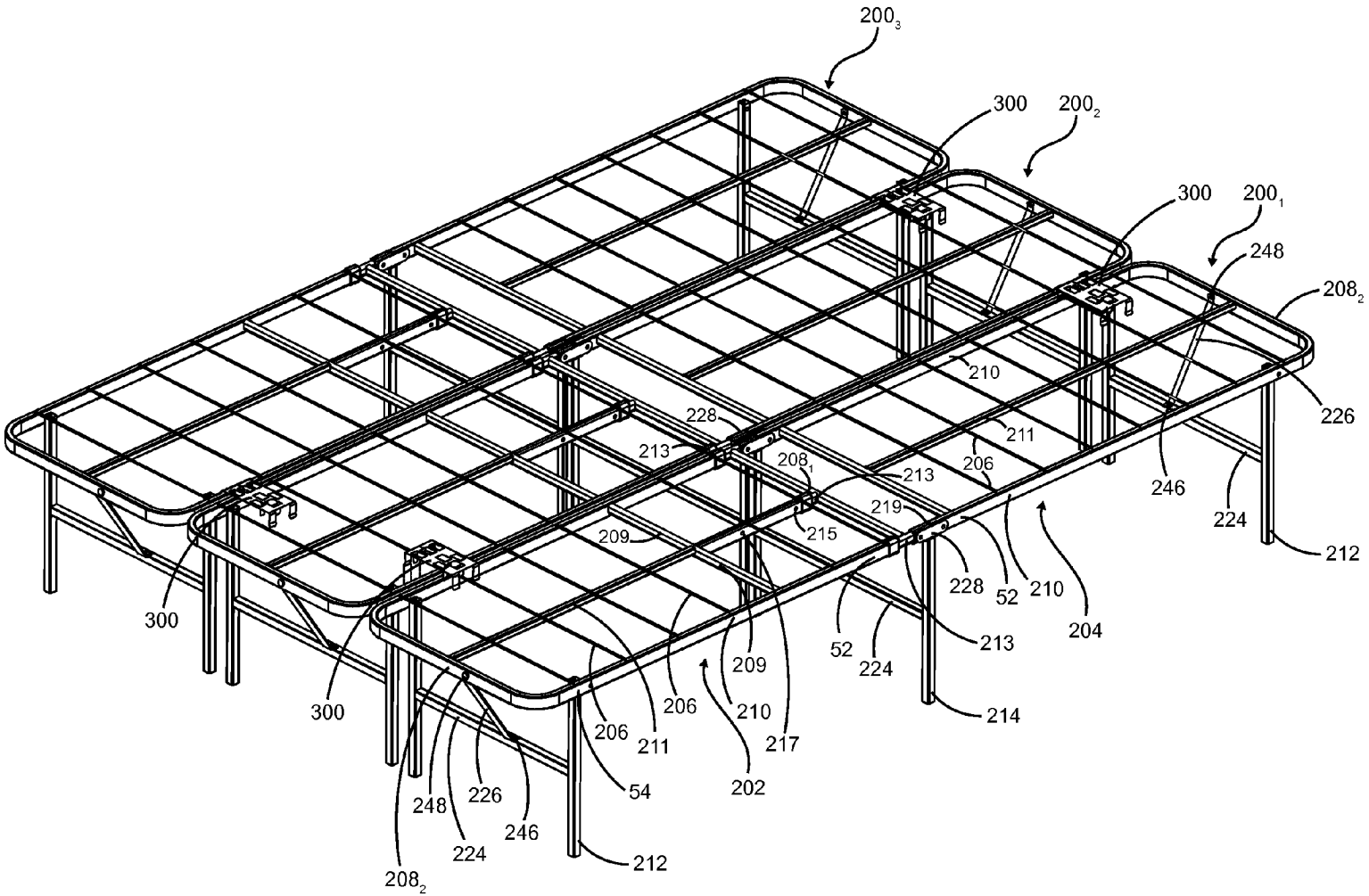
FIG. 7 is a perspective view of three adjacent foldable bed frames of a second embodiment of the present invention in an open configuration connected together with connecting brackets of a second embodiment of the present invention shown in FIG. 11 to form a full size bed frame.

Referring to FIG. 7, to construct a bed frame for a full size mattress (54"×75"), three bed frames $\mathbf{200}_1$, $\mathbf{200}_2$ and $\mathbf{200}_3$ with the longitudinal bars 210, 211 in a retracted configuration (75") are positioned adjacent to each other and a pair of third connecting brackets 300 are engaged in engaging spaces A and B with adjacent longitudinal support bars 210 to form a side-by-side-by-side configuration between adjacent bed frames $\mathbf{200}_1$, $\mathbf{200}_2$ and $\mathbf{200}_3$.

Figure 8:
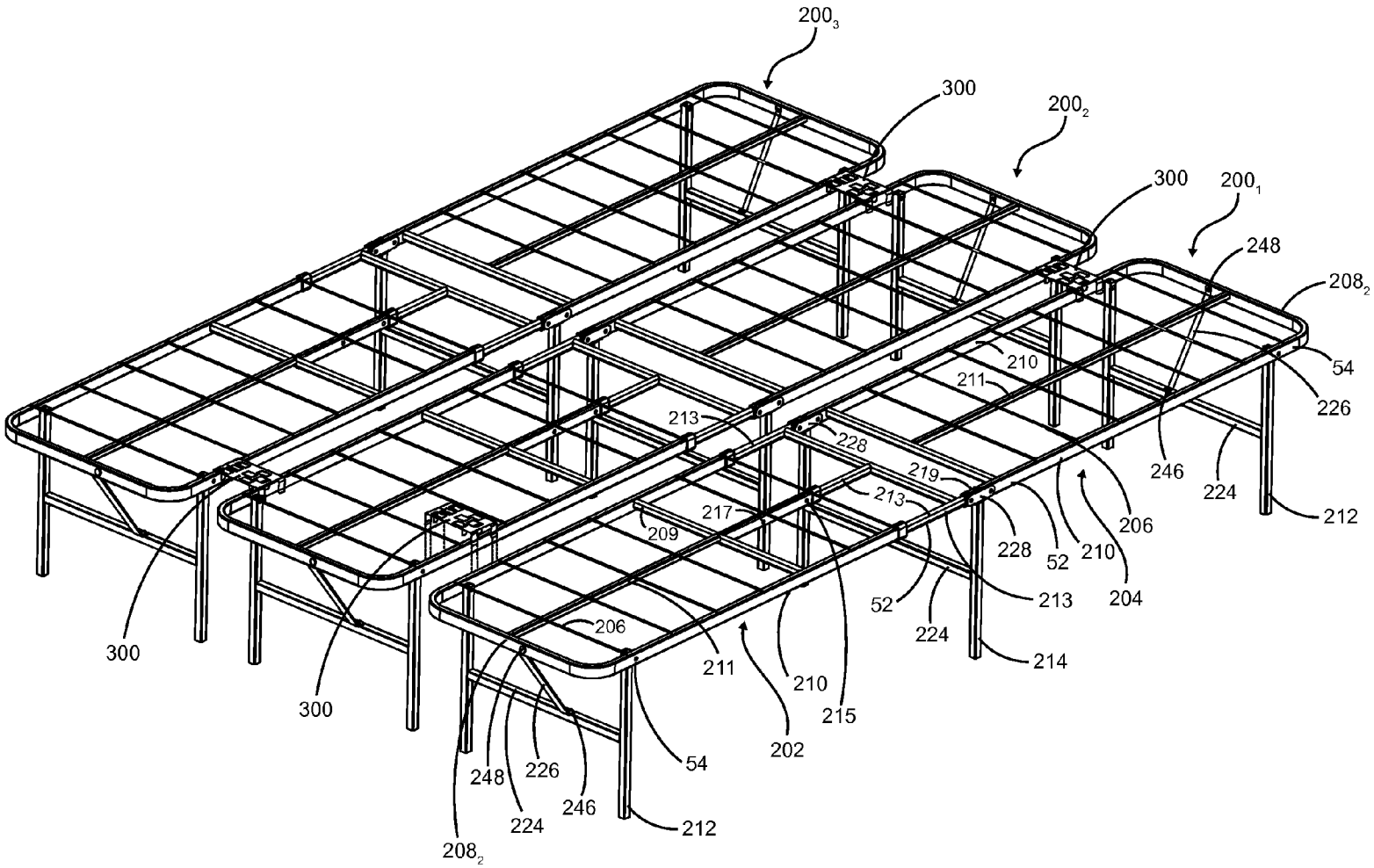
FIG. 8 is a perspective view of three adjacent foldable bed frames of a second embodiment of the present invention in an open and longitudinally extended configuration connected together with connecting brackets of a second embodiment of the present invention shown in FIG. 11 to form a queen size bed frame.

Referring to FIG. 8, to construct a bed frame for a queen size mattress (60"×80"), three bed frames $\mathbf{200}_1$, $\mathbf{200}_2$ and $\mathbf{200}_3$ with the longitudinal bars 210, 211 in an extended configuration (80") are positioned adjacent to each other and a pair of third connecting brackets 300 are engaged in engaging spaces A and D with adjacent longitudinal support bars 210 to form a 3" gap between each adjacent bed frame $\mathbf{200}_1$, $\mathbf{200}_2$ and $\mathbf{200}_3$.

Figure 9:
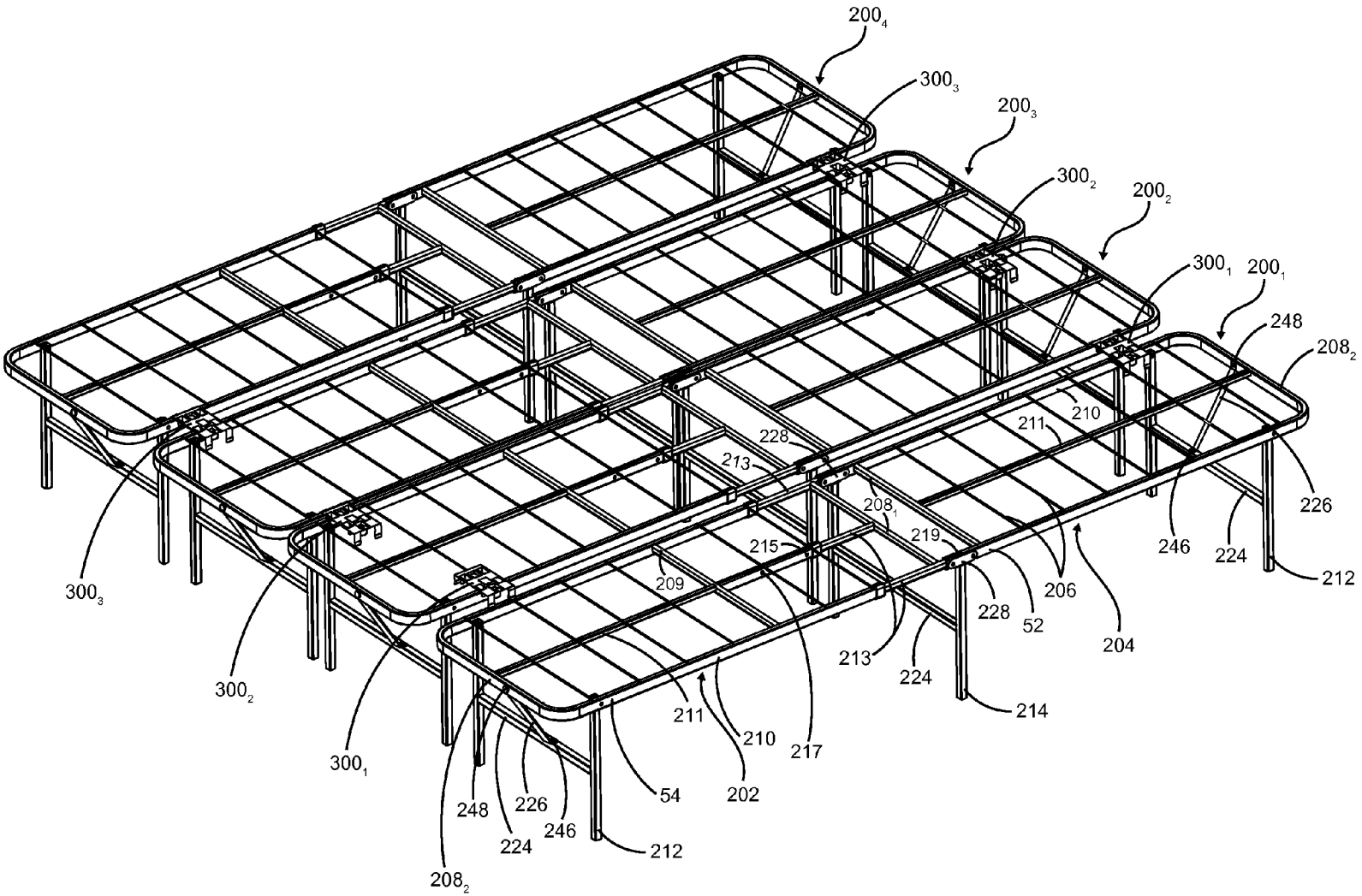
FIG. 9 is a perspective view of four adjacent foldable bed frames of a second embodiment of the present invention in an open and longitudinally extended configuration connected together with connecting brackets of a second embodiment of the present invention shown in FIG. 11 to form a king size bed frame.

Referring to FIG. 9, to construct a bed frame for a king size mattress (76"×80"), four bed frames $\mathbf{200}_1$, $\mathbf{200}_2$, $\mathbf{200}_3$ and $\mathbf{200}_4$ with the longitudinal bars 210, 211 in an extended configuration (80") are positioned adjacent to each other. A pair of third connecting brackets $\mathbf{300}_1$ are engaged in engaging spaces C and D with adjacent longitudinal support bars 210 of the first two bed frames $\mathbf{200}_1$ and $\mathbf{200}_2$ to form a 2" gap; a pair of third connecting brackets $\mathbf{300}_2$ are engaged in engaging spaces A and B with adjacent longitudinal support bars 210 of the second and third bed frames $\mathbf{200}_2$ and $\mathbf{200}_3$ to form a side-by-side configuration; and a pair of third connecting brackets $\mathbf{300}_3$ are engaged in engaging spaces C and D with adjacent longitudinal support bars 210 of the third and fourth bed frames $\mathbf{200}_3$ and $\mathbf{200}_4$ to form a 2" gap.

One of ordinary skill in the art will recognize that the dimensions of the bed frame 200 and third connecting bracket 300 could be modified to accommodate other mattress sizes, e.g., conventional Asian or European mattresses, without departing from the spirit and scope of the present invention.

Also, the peripheral support bars of each first sub-frame of the present invention are constructed of a hollow steel to reduce weight of the overall structure without compromising strength and durability. One of ordinary skill in the art will recognize, however, that other high strength and light-weight materials could be used for the peripheral support bars, such as composite materials or high strength plastics, without departing from the spirit and scope of the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The claims below are different than those of the parent application or other related applications. The Applicant therefore rescinds any disclaimer of claim scope made in the parent application or any predecessor application in relation to the instant application and further states that any disclaimer made in the instant application should not be read into or against the parent application.

The invention claimed is:

1. A foldable bed frame comprising:

a pair of first sub-frames, each first sub-frame comprising: a pair of spaced apart longitudinal bars, each longitudinal bar having a first end and a second end, each first sub-frame having a width extending between the pair of longitudinal bars, the opposing longitudinal bars fixedly connected together by at least a first lateral support bar proximate opposing longitudinal bar first ends and a second lateral support bar proximate opposing longitudinal bar second ends, the pair of first sub-frames pivotally connected together at corresponding first ends of the longitudinal bars by first pivotal connecting members;

a first leg assembly fixedly attached to the first sub-frames proximate the first pivotal connecting member;

a pair of second leg assemblies, each second leg assembly pivotally attached to each first sub-frame proximate second ends of opposing longitudinal bars; and a second sub-frame comprising a pair of spaced apart lateral extension bars, each lateral extension bar having a first end and a second end, the second sub-frame having a length extending between the first and second ends of the pair of lateral extension bars, wherein said length is at least half of the width of the first sub-frame, the first ends of each lateral extension bar pivotally connected to a longitudinal bar of one of the first sub-frames by a second pivotal connecting member, the second ends of each lateral extension bar having a first coupling member fixedly attached thereto, wherein in a retracted configuration the second sub-frame is disposed within and substantially co-planar with the one of the first sub-frames, and in an extended configuration the second sub-frame is pivotally extended adjacent to and substantially co-planar with the first sub-frame;

wherein the pair of first sub-frames are pivotable from an open configuration whereby each first sub-frame is aligned longitudinally to form a generally rectangular co-planar support surface and a folded configuration whereby each first sub-frame is substantially overlapped and adjacent to each other.

2. A foldable bed frame according to claim 1, further comprising a support brace detachably connecting each second leg assembly and each first sub-frame when the bed frame is in the open configuration.

3. A foldable bed frame according to claim 1, wherein each second leg assembly is pivotally connected to the second lateral support bar of each first sub-frame and pivotable toward a lower portion of corresponding first sub-frames when the bed frame is in the folded configuration.

4. A foldable bed frame according to claim 1, wherein each first coupling member of each lateral extension bar is substantially U-shaped for securing to an additional structure adjacent to the foldable bed frame.

5. A foldable bed frame according to claim 1, wherein the second pivotal connecting member is substantially U-shaped for securing to a corresponding first sub-frame when the second sub-frame is in the extended configuration.

6. A foldable bed frame according to claim 1, further comprising a second coupling member including a base having a plurality of opposing outer walls extending downwardly from opposing edges of the base and at least one inner wall extending downwardly from an inner portion of the base substantially parallel to the outer walls such that a plurality of engaging spaces are formed between the walls.

7. A foldable bed frame according to claim 6, wherein in the open configuration one of the plurality of engaging spaces is engaged with one of the first sub-frames and another one of the plurality of engaging spaces is engaged with an adjacent structure to provide an expanded mattress engaging surface.

8. A foldable bed frame comprising:

a pair of first sub-frames, each first sub-frame comprising: a pair of opposing spaced apart longitudinal bars, each longitudinal bar having a first end and a second end, the opposing longitudinal bars fixedly connected together by at least a first lateral support bar proximate opposing longitudinal bar first ends and a second lateral support bar proximate opposing longitudinal bar second ends, the pair of first sub-frames pivotally connected together proximate corresponding longitudinal bar first ends by first pivotal connecting members, the opposing longitudinal bars of at least one first sub-frame being extendable with respect to the first pivotal connecting members along longitudinal axis of the at least one first sub-frame;

a first leg assembly fixedly attached to the first sub-frames proximate the first pivotal connecting member;

a pair of second leg assemblies, each second leg assembly pivotally attached to each first sub-frame proximate second ends of opposing longitudinal bars;

wherein the pair of first sub-frames are pivotable from an open configuration wherein each first sub-frame is aligned longitudinally to form a generally rectangular co-planar support surface, and a folded configuration wherein each first sub-frame is substantially overlapped and adjacent to each other.

9. A foldable bed frame according to claim 8, further comprising a support brace detachably connecting each second leg assembly and each first sub-frame when the bed frame is in the open configuration.

10. A foldable bed frame according to claim 8, further comprising a coupling member including a base having a plurality of opposing outer walls extending downwardly from opposing edges of the base and at least one inner wall extending downwardly from an inner portion of the base substantially parallel to the outer walls such that a plurality of engaging spaces are formed between the walls.

11. A foldable bed frame according to claim 10, wherein in the open configuration of the bed frame one of the plurality of engaging spaces is engaged with one of the first sub-frames and another one of the plurality of engaging spaces is engaged with an additional adjacent bed frame to form a larger surface area.

12. A foldable bed frame according to claim 10, wherein a predetermined combination of engaging spaces corresponds to a predetermined mattress size.

13. A foldable bed frame according to claim 8, wherein the extendable longitudinal bars of the at least one first sub-frame are extended to provide a larger mattress support surface.

14. A foldable bed frame comprising:

a pair of first sub-frames, each first sub-frame comprising: a pair of spaced apart longitudinal bars, each longitudinal bar having a first end and a second end, the opposing longitudinal bars fixedly connected together by a plurality of lateral support bars, the pair of first sub-frames pivotally connected together at corresponding longitudinal bar first ends by first pivotal connecting members, wherein the pair of first sub-frames are pivotable from an open configuration whereby each first sub-frame is aligned longitudinally to form a generally rectangular co-planar support surface and a folded configuration whereby each first sub-frame is substantially overlapped and adjacent to each other;

a first leg assembly fixedly attached to the first sub-frames proximate the first pivotal connecting member;

a pair of second leg assemblies, each second leg assembly pivotally attached to each first sub-frame; and at least one coupling member for attaching the first sub-frames to an adjacent structure;

wherein the at least one coupling member comprises a base having a plurality of opposing outer walls extending downwardly from opposing edges of the base and at least one inner wall extending downwardly from an inner portion of the base substantially parallel to the outer walls such that a plurality of engaging spaces are formed between the walls.

15. A foldable bed frame according to claim 14, wherein each engaging space corresponds to a predetermined mattress size.

16. A foldable bed frame according to claim 14, wherein in the open configuration of the bed frame one of the plurality of engaging spaces is engaged with one of the first sub-frames and another one of the plurality of engaging spaces is engaged with an adjacent structure to form a larger mattress engaging surface.

17. A foldable bed frame comprising:

a pair of first sub-frames, each first sub-frame comprising: a pair of spaced apart longitudinal bars, each longitudinal bar having a first end and a second end, the opposing longitudinal bars fixedly connected together by a plurality of lateral support bars, the pair of first sub-frames pivotally connected together at corresponding longitudinal bar first ends by first pivotal connecting members, wherein the pair of first sub-frames are pivotable from an open configuration whereby each first sub-frame is aligned longitudinally to form a generally rectangular co-planar support surface and a folded configuration whereby each first sub-frame is substantially overlapped and adjacent to each other;

a first leg assembly fixedly attached to the first sub-frames proximate the first pivotal connecting member;

a pair of second leg assemblies, each second leg assembly pivotally attached to each first sub-frame; and at least one coupling member for attaching the first sub-frames to an adjacent structure;

wherein the longitudinal bars of at least one first sub-frame are longitudinally extendable.

18. An extendable folding bed frame according to claim 17, wherein the longitudinal bars are extendable telescopically.

* * * * *

UNITED STATES PATENT AND TRADEMARK OFFICE

CERTIFICATE OF CORRECTION

PATENT NO. : 8,621,685 B2
APPLICATION NO. : 13/469522
DATED : January 7, 2014
INVENTOR(S) : Ki Ho Jin It is certified that error appears in the above-identified patent and that said Letters Patent is hereby corrected as shown below:

On the title page, Item (63), "Related U.S. Application Data" and the text "Continuation-in-part of application No. 12/653,315, filed on Dec. 11, 2009." should be deleted.

Signed and Sealed this
Eighteenth Day of March, 2014

Michelle K. Lee

Michelle K. Lee
*Deputy Director of the United States Patent and Trademark Office*